United States Patent [19]

Collette

[11] 4,305,501

[45] Dec. 15, 1981

[54] PACKAGE FOR TOY ELASTOMER BALLOONS

[75] Inventor: Murray P. Collette, Hudson, Ohio

[73] Assignee: The Oak Rubber Company, Ravenna, Ohio

[21] Appl. No.: 889,184

[22] Filed: Mar. 23, 1978

[51] Int. Cl.[3] ..... B65D 33/04

[52] U.S. Cl. ..... 206/457; 206/45.33; 206/459; 434/429; 46/87

[58] Field of Search ..... 206/457, 458, 459, 45.33, 206/45.31, 45.34, 803; 35/49; 46/87

[56] References Cited

U.S. PATENT DOCUMENTS 1,446,836 2/1923 Crupain ..... 206/457

2,518,711 8/1950 Mulford ..... 206/45.31

2,974,782 3/1961 Walters ..... 206/45.33

OTHER PUBLICATIONS

Edmund Scientific Co. Catalog, 1974, pp. 2 and 54.

*Primary Examiner*—William T. Dixson, Jr.

*Attorney, Agent, or Firm*—Watts, Hoffmann, Fisher & Heinke Co.

[57] ABSTRACT

A package for non-inflated toy elastomer balloons of like size having on the exterior thereof a picture of one of the balloons inflated to optimum size being held by a child of recognizable size thus indicating the size to which the balloons in the package can be inflated without deleterious effect to the balloon.

3 Claims, 1 Drawing Figure

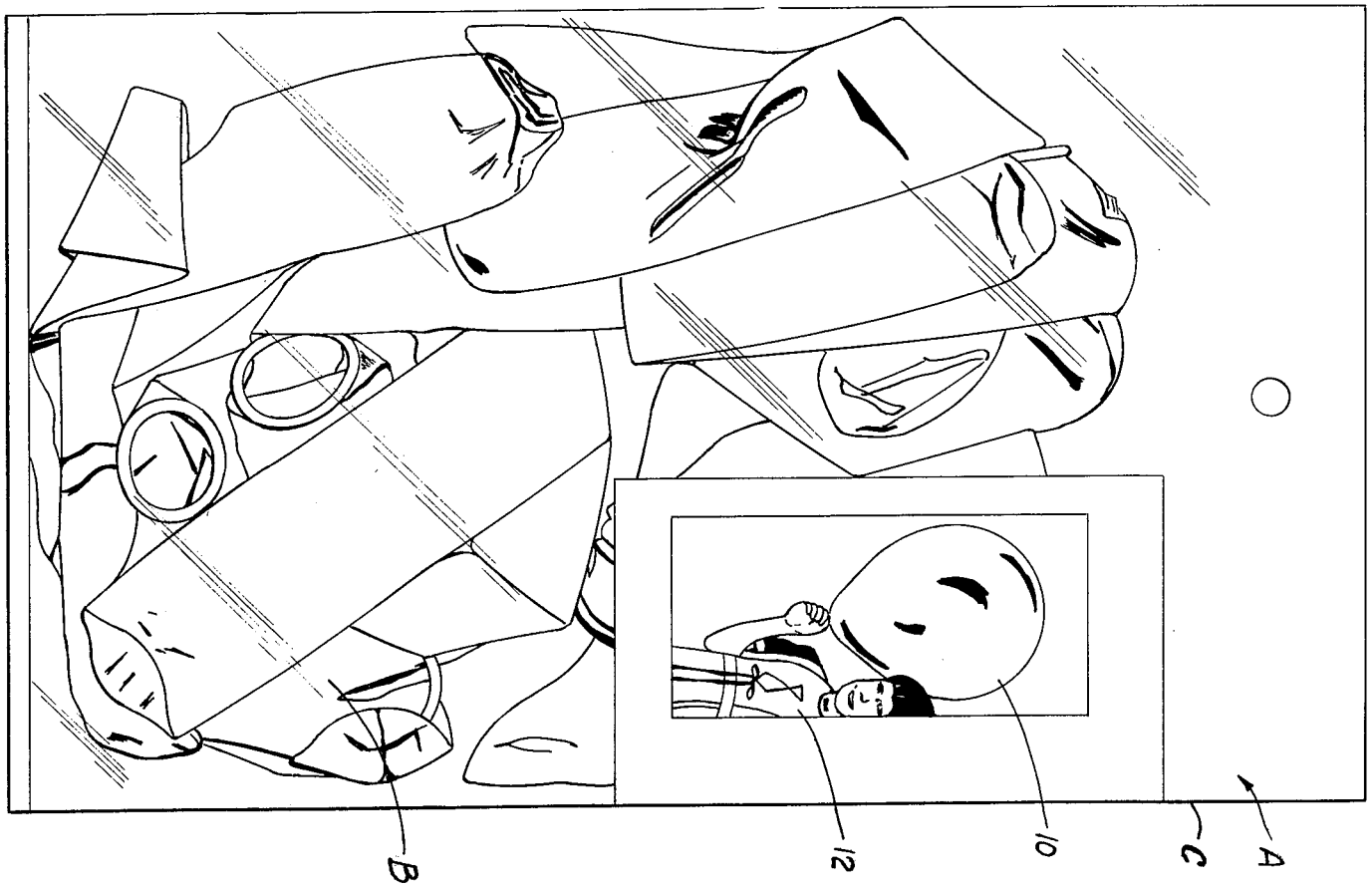
A
C
10
12
B

PACKAGE FOR TOY ELASTOMER BALLOONS

BACKGROUND OF THE INVENTION

1. Field of the Invention

The invention relates to the packaging of inflatable elastomer articles such as toy balloons.

2. Description of the Prior Art

Prior to the present invention inflatable elastomer articles, such as, toy balloons were typically sold in containers having printed on their exteriors the optimum size in inches, centimeters etc., to which the article in the package should be inflated. Many such articles were dispensed to children and others who did not notice the size printed on the container to which the article should be inflated and/or to whom the printed size meant very little if anything.

SUMMARY OF THE PRESENT INVENTION

The present invention provides a novel and improved package for merchandising inflatable elastomer articles, such as, toy balloons which package indicates at a glance in a very conspicuous and universally recognized manner the optimum size to which the article in the package should be inflated, that is, without dilaterious effect to the article, to any person capable of inflating the article regardless of the person's reading ability, by illustrating on the package the elastomer article inflated to optimum size in association with an article of recognizable size.

Other objects and advantages of the invention will be hereinafter referred to and/or will be apparent to those skilled in the art to which the invention relates from the following description of the preferred embodiment of the invention.

BRIEF DESCRIPTION OF THE DRAWINGS

The drawings depict an inflatable elastic balloon package constructed in accordance with the present invention.

DESCRIPTION OF THE PREFERRED EMBODIMENT

Referring to the drawing the reference character A designates a package comprising an envelope-like receptacle C made of transparent material containing a plurality of non-inflated toy balloons B made of elastic material and having an optimum inflatable size. A picture of a like balloon 10 inflated to the optimum size previously determined associated with an article 12, in the present instance a child of readily recognized size was taken and reproduced on the package A. Thus readily indicating to a recipient of the package A of balloons B the optimum size to which the balloons B may be inflated without dilaterious effect.

As previously mentioned toy elastomer balloons have typically been merchandised and sold at retail in packages having printed thereon in inches, and/or centimeters etc., the sizes to which the balloons should be inflated. These instructions were often unnoticed by the inflater of the article or meant little, if anything, to the inflater with the result that the article was often inflated beyond its optimum or intended size. With the present invention the size to which the article in the package can be inflated is conspicuously displayed on the package in a manner universally recognized regardless of the recipients reading ability. By comparing the size of the child pictured on the package holding an inflated article like that in the package anyone can see at a glance the approximate size to which the article can and/or should be inflated.

From the foregoing disclosure of the invention it will be apparent that the objects heretofore mentioned and others have been accomplished and that there has been provided a novel and improved package for non-inflated elastomer articles which indicate at a glance to a purchaser or the like, regardless of their reading ability, the optimum size to which the article in the package can be inflated.

What is claimed is:

1. As an article of commerce a package comprising a container of transparent material having a plurality of like noninflated inflatable toy elastomer balloons visible therein and having an illustration of a like toy balloon inflated to optimum size associated with an article of readily recognizable size.

2. As an article of commerce a package comprising a container of transparent material having a plurality of like noninflated inflatable elastomer toy balloons visible therein and having an illustration of a child holding a like toy balloon inflated to optimum size.

3. A method of making a package for elastomeric inflatable toy balloons of like size and shape, comprising:

inflating an elastomeric inflatable toy balloon and determining its optimum inflated size, providing a container of transparent material large enough to contain several toy balloons substantially identical in size, material and shape to the said toy balloon prior to inflation, affixing an indicia on the container of an illustration of a toy balloon equivalent to those to be packaged, inflated to optimum size held by an illustration of a child and in a relationship to the child that illustrates the actual optimum inflated size of the balloon based on the size of the child illustrated, and packaging in said container several noninflated toy balloons substantially identical in size, shape and material to said toy balloon that was inflated and illustrated.

* * * * *